US005135414A

United States Patent [19]

van Dijk

[11] Patent Number: 5,135,414

[45] Date of Patent: Aug. 4, 1992

[54] STAMPED AND FORMED ELECTRICAL TAB

[75] Inventor: Petrus R. M. van Dijk, 's-Hertogenbosch, Netherlands

[73] Assignee: AMP Incorporated, Harrisburg, Pa.

[21] Appl. No.: 802,073

[22] Filed: Dec. 3, 1991

[30] Foreign Application Priority Data

Dec. 21, 1990 [GB] United Kingdom ..... 9027858

[51] Int. Cl.[5] ..... H01R 13/04

[52] U.S. Cl. ..... 439/692; 439/660

[58] Field of Search ..... 439/660, 692–697, 439/851–857, 861, 862, 387

[56] References Cited

U.S. PATENT DOCUMENTS

| | | | |
|---|---|---|---|
| 2,542,609 | 2/1951 | Wyglendowski | 439/694 |
| 3,333,225 | 7/1967 | McNutt | 439/692 |
| 4,687,278 | 8/1987 | Grabbe et al. | 439/842 |

OTHER PUBLICATIONS

Page 20, Mar. 1989 issue *Connection Technology.*

*Primary Examiner*—David L. Pirlot

*Attorney, Agent, or Firm*—Eric J. Groen; Bruce J. Wolstoncroft

[57] ABSTRACT

The tab is for mating with an electrical receptacle having oppositely bowed, gold plated, contact surfaces. The tab has a gold plated contact portion, one side of which is formed with two small radius, smoothly convex ribs extending along opposite margins of the one side for good wiping contact with one of the contact surfaces of the receptacle. The opposite side of the contact portion is formed with a single, smoothly arcuate rib for engaging the other contact surface of the receptacle to provide high durability contact therewith, the single rib being of much greater radius than either of the two ribs.

16 Claims, 3 Drawing Sheets

STAMPED AND FORMED ELECTRICAL TAB

BACKGROUND OF THE INVENTION

1. Field of the Invention

The invention relates to a stamped and formed electrical tab.

2. Description of the Prior Art

There is disclosed in Connection Technology, Mar. 1989, at Page 20 a stamped and formed elongate electrical tab for mating with an electrical receptacle having oppositely bowed contact surfaces for receiving the tab between them, the contact surfaces being plated with a coating of corrosion resistant metal of high electrical conductivity, the tab being of substantially rectangular cross section and having a longitudinally extending contact portion also plated with a coating of corrosion resistant metal of high electrical conductivity, opposite sides of the contact portion each having been formed with an outwardly radiused, smoothly convex rib extending along the contact portion.

The ribs, which are intended to make point contact with the contact surfaces of the receptacle and to wipe these contact surfaces, are of equal radius, and, as seen in cross section, each rib extends across the whole of the respective side of the contact portion, from which the rib projects.

A problem in designing tabs for mating with such electrical receptacles, is to provide not only for a good wiping action by the contact surfaces of the tab, but also for good wear resistance of the plating on the contact surfaces, that is to say for high durability thereof, since the wiping action will tend to remove plating on the contact surfaces of both the pin and the receptacle.

SUMMARY OF THE INVENTION

According to one aspect of the present invention, an electrical tab as defined in the second paragraph of this specification, is characterized in that one of said opposite sides of the contact portion is formed with two outwardly radiused, smoothly convex ribs extending along opposite margins of said one side, the other opposite side of the contact portion being formed with a single, said other side centrally thereof, between said two ribs and parallel thereto and being of substantially greater radius than the radius of either of said two ribs.

Thus, said two ribs of smaller radius, will serve to wipe one of the contact surfaces of the receptacle, said single rib, of larger radius, not being likely to penetrate the plating in the other contact surface of the receptacle, so as to provide for high durability contact with that contact surface.

The two ribs may be of equal radius, the ratio of the radii of the two ribs and said single rib may approximate to 1:10. For example, the radius of each of the two ribs may be 0.025mm, that of the single rib being 0.25mm. Said one opposite side of the contact portion, should be that on the edges of which burrs have been formed as a result of the stamping out of the tab from a piece of sheet metal stock. The single rib, which lies between the burred edges, serves to stand them off from the contact surface of the receptacle that is engaged by the single rib. The pin thus needs no further forming after its removal from the initial forming dies.

Said two ribs, may be of different radii to provide different degrees of wiping action.

Conceivably, there could be more than two smaller radius ribs on said one opposite side and more than one larger radiused rib on said other opposite side.

According to another aspect of the invention, a stamped and formed electrical tab for mating with an electrical receptacle having oppositely bowed contact surfaces for receiving the tab between them, the contact surfaces having been plated with a coating of corrosion resistant metal of high electrical conductivity, the tab being of substantially rectangular cross section having opposite major sides and opposite minor sides, the tab having a longitudinally extending contact position, also plated with a coating of corrosion resistant metal of high electrical conductivity, the opposite major sides of the contact position being formed with outwardly radiused, smoothly convex ribs extending longitudinally of the contact portion; is characterized in that one of the opposite major sides is formed with a plurality of outwardly radiused, smoothly convex first ribs extending along said one major side, the other major side of the contact portion being formed with at least one outwardly radiused, smoothly convex second rib extending along said other major side, parallel with said first ribs and being of substantially greater radius than any of those ribs.

DETAILED DESCRIPTION OF THE PREFERRED EMBODIMENT

Figure 2:
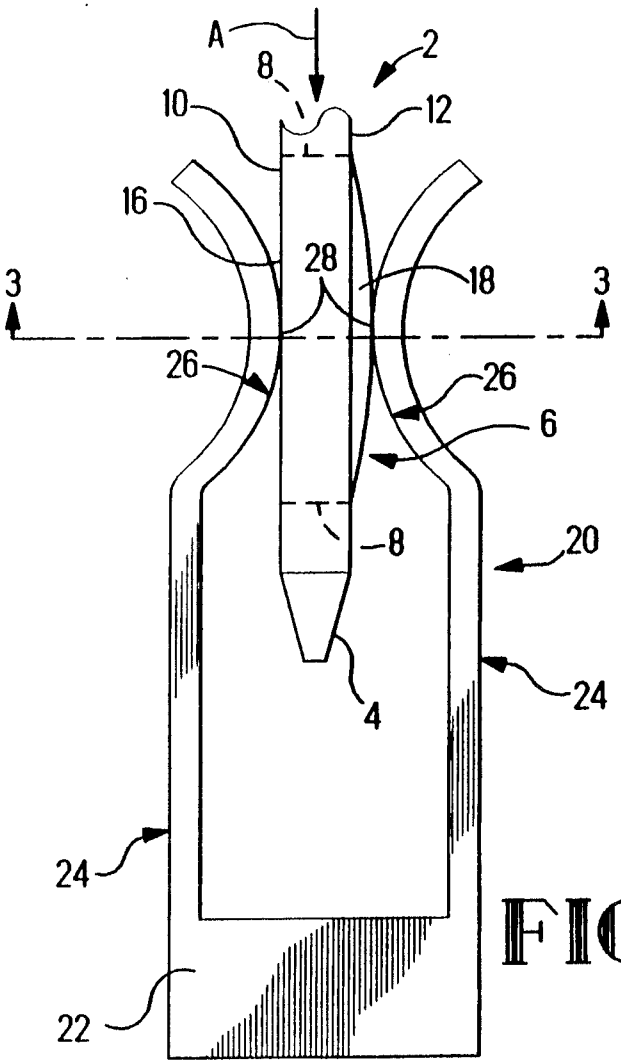
FIGS. 1 to 3 are a side view, an end view, and a cross sectional view, respectively, showing a stamped and formed metal tab for mating with a receptacle therefore, and illustrating, in diagrammatic form, the principles of the invention, FIG. 3 being a view taken on the lines 3—3 of FIG. 2.
Figure 1:
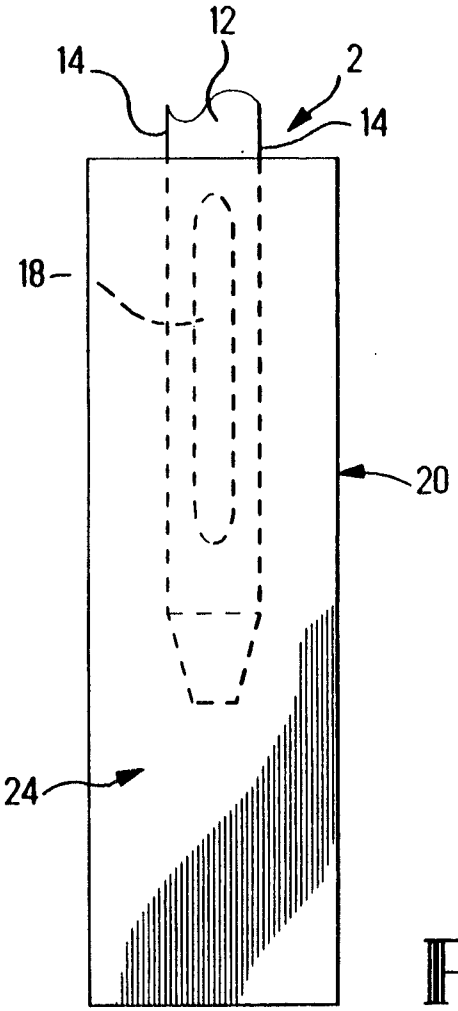
Figure 3:
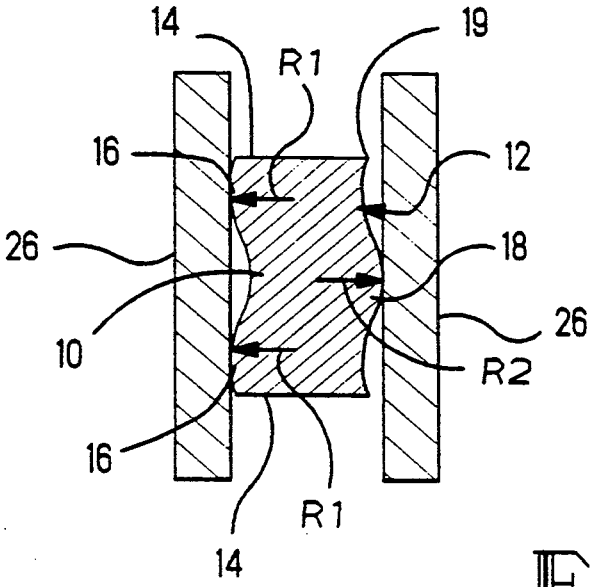
Figure 4:
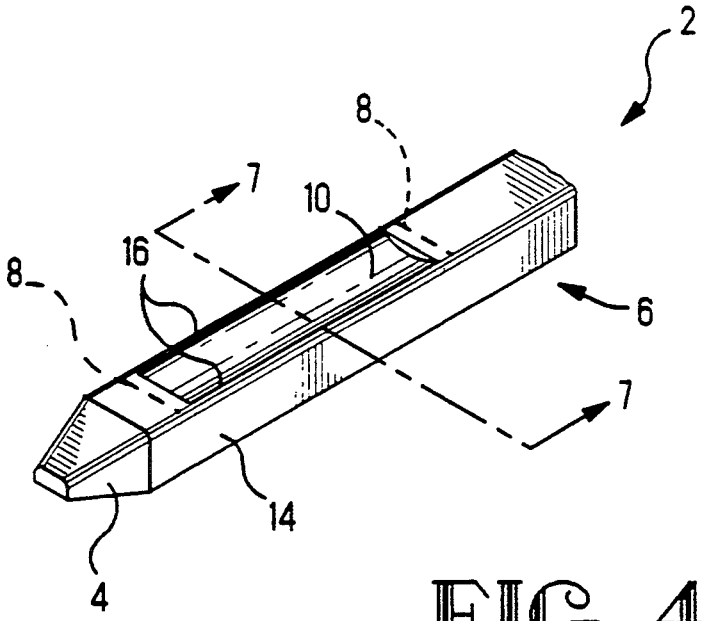
FIG. 4 is a perspective view of a computer generated model of the tab for practical use.
Figure 5:
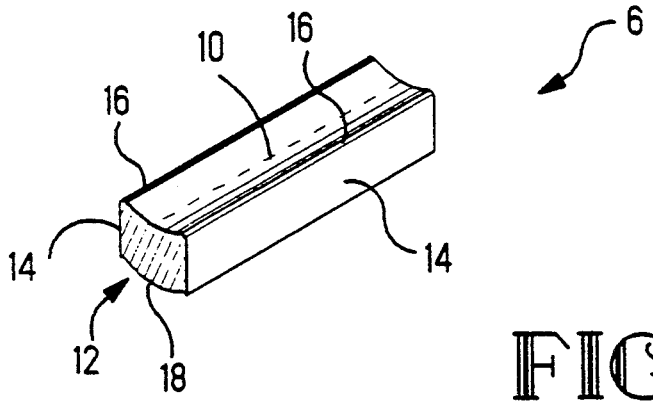
FIG. 5 is a perspective view of the contact portion of the tab shown in FIG. 4.
Figure 6:
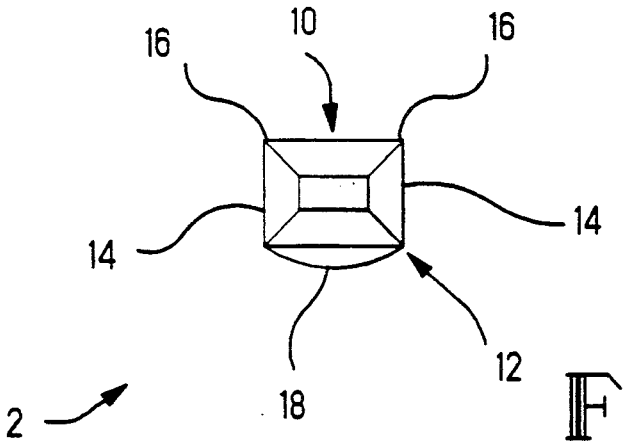
FIG. 6 is an enlarged front end view of the tab shown in FIG. 4.
Figure 7:
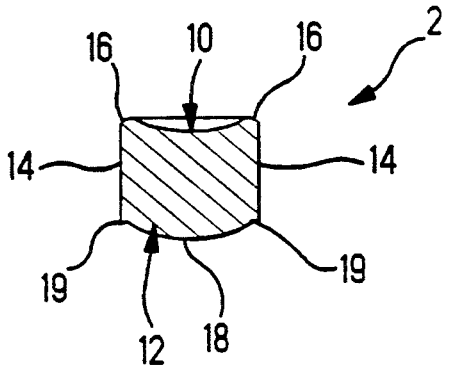
FIG. 7 is an enlarged view taken on the lines 7—7 of FIG. 4.

Reference will now be made to FIGS. 1 to 3. A metal tab 2 which has been stamped and formed from a single piece of metal stock, for example brass stock, has a chamfered leading end portion 4 and a formed contact portion 6 located back from the portion 4 and extending longitudinally of the pin 2, the extent of the contact portion 6 being indicated by broken lines 8 in FIG. 2. The remainder of the tab 2 is of substantially rectangular cross section. At least the mating part of the portion 6 of the pin 2 has been plated with a thin layer of corrosion resistant material of high electrical conductivity, for example gold. The thickness of the plating may be for example of 1 micron. The tab 2 has opposite major sides 10 and 12 and opposite minor sides 14.

The major side 10 is formed with two upwardly radiused, smoothly convex ribs 16 extending along opposite margins of the side 10, each rib 16 tapering in height in the vicinity of its ends. The side 12 is formed with a single, outwardly radiused, smoothly convexed rib 18 extending along the side 12 centrally thereof and being located between the two ribs 16, the rib 18 tapering in height towards its ends. The ribs 16 are of substantially equal radius R1, the radius R2 of the rib 18 being many times greater than the radius R1. There project from the edges of the major face 10, burrs 19 produced as a result of the stamping out of the tab 2 from the metal stock.

The tab 2 is configured for mating with a sheet metal electrical receptacle 20 of the tulip type, having a base 22 from which extend a pair of opposite contact springs 24 having opposed, smoothly inwardly bowed contact surfaces 26. At least the surfaces 26 of the receptacle 20 are plated with a coating or a corrosion resistant metal of high electrical conductivity, for example gold.

As the tab 2 is being inserted into the receptacle 20 in the direction of the arrow A in FIG. 2, the chamfered end portion 4 of the tab 2 cams the contact surfaces 26 resiliently apart, the crests 28 of the surfaces 26, then riding up the tapered leading ends of the ribs 16 and 18. The tab 2 is inserted into the receptacle 20 to the extent that the crests 28 engage the ribs 16 and 18 in the general region of their longitudinal centers. Since the burrs 19 are stood off from the left hand contact surface 26 by the rib 18, the burrs 19, cannot damage the plating on that contact surface and so do not need to be removed in order to enable the tab 2 to be used. The extent of penetration of the tab 2 into the receptacle 20 may be limited by means of housing thereof which are not shown.

During the insertion of the tab 2, the smaller radius ribs 26 serve to wipe away any fouling that there may be in the vicinity of the crest 28 of the contact surface 26 which is engaged by the ribs 16, and/or on the ribs 16 themselves, whereas the larger radius single rib 18 presents a smooth, wear resistant contact surface for high durability, electrical contact with the other contact surface 26. By virtue of the curvature of the ribs 16 and 18, and of the contact surfaces 26, which act in the manner of crossed cylindrical surfaces, the ribs 16 and 18 make point contact with the crests 28 of the respective contact surfaces 26, to provide optimal electrical connection between the tab 2 and the receptacle 20. Also, the ribs 16 and 18 provide contact redundancy.

In the model shown in FIGS. 4 to 7, the radius R1 of each rib 16 is equal to 0.025mm, the radius R2 of the R2 is approximate to 1:1O: Diagrammatic representation of the burrs 19 has been added to FIG. 7.

I claim:

1. A stamped and formed elongate electrical tab for mating with an electrical receptacle having oppositely bowed contact surfaces for receiving the tab between them, the contact surfaces having been plated with a coating of corrosion resistant metal of high electrical conductivity, the tab being of substantially rectangular cross section and having a longitudinally extending contact portion, also plated with a coating of corrosion resistant metal of high electrical conductivity, opposite sides of the contact portion each being formed with an outwardly radiused, smoothly convex rib extending longitudinally to the contact portion; characterized in that one of said opposite sides of the contact portion is formed with two outwardly radiused, smoothly convex first ribs extending along opposite margins of said one side, the other opposite side of the contact portion being formed with a single, outwardly radiused, smoothly convex second rib extending along said other opposite side centrally thereof between said two first ribs and parallel thereto, and being of substantially greater radius than the radius of either of said two first ribs.

2. A tab as claimed in claim 1, characterized in that the radii of said two first ribs are unequal.

3. A tab as claimed in claim 1, characterized in that said opposite sides of the contact portion are major sides thereof.

4. A tab as claimed in claim 1, characterized in that said first and second ribs are tapered in height towards a leading end portion of the tab.

5. A tab as claimed in claim 1, wherein burrs formed as a result of the tab having been stamped from sheet metal stock, project from longitudinal edges of said one opposite side containing said second rib.

6. A tab as claimed in claim 1, characterized in that the radii of said two first ribs are equal, the radius of said second rib being many times greater than the radius of each of said two first ribs.

7. A tab as claimed in claim 6, characterized in that the ratio of said radii is approximately 1:10.

8. A tab as claimed in claim 6, characterized in that the radius of each of said two first ribs is 0.025mm, that radius of said second rib being 0.25mm.

9. A stamped and formed electrical tab for mating with an electrical receptacle having oppositely bowed contact surfaces for receiving the tab between them, the contact surfaces having been plated with a coating of corrosion resistant metal of high electrical conductivity, the tab being of substantially rectangular cross section having opposite major sides and opposite minor sides, the tab having a longitudinally extending contact portion, also plated with a coating of corrosion resistant metal of high electrical conductivity, the opposite major sides of the contact position being formed with outwardly radiused, smoothly convex rib extending longitudinally of the contact portion; characterized in that one of the opposite major sides is formed with a plurality of outwardly radiused, smoothly convex first ribs extending along said one major side, the other major side of the contact position being formed with at least one outwardly radiused, smoothly convex second rib extending along said other major side, parallel with said first time ribs and being of substantially greater radius than any of the two first ribs.

10. A tab as claimed in claim 9, characterized in that the radii of said two first ribs are unequal.

11. A tab as claimed in claim 9, characterized in that said opposite sides of the contact portion are major sides thereof.

12. A tab as claimed in claim 9, characterized in that said first and second ribs are tapered in height towards a leading end portion of the tab.

13. A tab as claimed in claim 9, wherein burrs formed as a result of the tab having been stamped from sheet metal stock, project from longitudinal edges of said one opposite side containing said second rib.

14. A tab as claimed in claim 9 characterized in that the radii of said two first ribs are equal, the radius of said second rib being many times greater than the radius of each of said two first ribs.

15. A tab as claimed in claim 14, characterized in that the ratio of said radii is approximately 1:10.

16. A tab as claimed in claim 14, characterized in that the radius of each of said two first ribs is 0.025mm, the radius of said second rib being 0.25mm.

* * * * *

UNITED STATES PATENT AND TRADEMARK OFFICE

CERTIFICATE OF CORRECTION

PATENT NO. : 5,135,414

DATED : August 4, 1992

INVENTOR(S) : Petrus R. M. van Dijk

It is certified that error appears in the above-indentified patent and that said Letters Patent is hereby corrected as shown below:

In Claim 9, column 4, line 41 delete "time".

Signed and Sealed this

Twenty-fourth Day of August, 1993

Bruce Lehman

*Attest:*

BRUCE LEHMAN

*Attesting Officer*

*Commissioner of Patents and Trademarks*